US005950770A

United States Patent [19]

Koeppe, Jr. et al.

[11] Patent Number: 5,950,770

[45] Date of Patent: Sep. 14, 1999

[54] CONNECTING ELEMENT FOR ELEVATOR GUIDE RAIL

[75] Inventors: Robert J. Koeppe, Jr., Newton; Vincent Robibero, Randolph; Joseph M. Racanelli, Edison, all of N.J.

[73] Assignee: Inventio AG, Hergiswil, Switzerland

[21] Appl. No.: 09/013,016

[22] Filed: Jan. 26, 1998

[51] Int. Cl.[6] ..... B66B 7/02

[52] U.S. Cl. ..... 187/406; 238/135

[58] Field of Search ..... 187/406, 408, 187/414; 238/134, 135, 138, 351

[56] References Cited

U.S. PATENT DOCUMENTS 4,637,496 1/1987 Atkey et al. ..... 187/95

FOREIGN PATENT DOCUMENTS 0 506 216 9/1992 European Pat. Off. .

1261666 9/1961 France .

804743 11/1958 United Kingdom .

2 174 976 11/1986 United Kingdom .

*Primary Examiner*—Kenneth W. Noland

*Attorney, Agent, or Firm*—Macmillan, Sobanski & Todd, LLC

[57] ABSTRACT

A guide rail system for guiding an elevator car or a counterweight in an elevator shaft includes a pair of Ω-shaped guide rails (1, 2) having adjacent ends connected by a connecting element. The guide rails (1, 2) have a hollow cylinder-shaped rail body (3) with a pair of flat ends (4, 5). The connecting element includes a tube-shaped connecting member (6) inserted into the rail bodies and a base plate (7, 7*a*, 7*b*, 7*c*) placed under the free ends (4, 5) and attached thereto by fasteners (12). A wedge body (10, 10*a*, 10*b*) on the base plate (7, 7*a*, 7*b*, 7*c*) extends into an opening (11, 15) formed in the connecting member (6) to expand the connecting member into locking engagement with the guide rails (1, 2).

7 Claims, 3 Drawing Sheets

CONNECTING ELEMENT FOR ELEVATOR GUIDE RAIL

BACKGROUND OF THE INVENTION

The present invention relates to a connecting element for an elevator car or a counterweight guide rail with a tube shaped rail body and free ends for the attachment to a beam wherein two guide rails in the rail assembly are connected by a tube shaped connecting member and a cooperating base plate.

A common form of elevator guide rail has a T-shaped construction which, when installed in an elevator shaft, has the top or cross portion of the "T" facing the shaft wall and the bottom or body of the "T" facing in a direction whereby wheels or rollers can run on the exposed surfaces of the body. The T-shaped guide rail has several disadvantages that include a concentration of a majority of the material at the center of the "T" resulting in a low stiffness to weight ratio, relatively heavy rail sections that are difficult to move and install, a relatively short spacing between rail brackets to compensate for the relatively low stiffness, and significant machining of the rail surfaces being required for proper alignment of the sections.

The U.S. Pat. No. 4,637,496 shows a connecting element for Ω-shaped guide rails. The guide rail has a hollow cylinder shaped rail body with opposed flat portions or ends. The flat ends and the rail body are one piece and have a cross section in the shape of an Ω symbol. A tube shaped connecting member is inserted into the rail body, with approximately one half of the length of the member extending from the rail body. On the edge of each of the flat ends, a holding member is attached. The holding members of the opposed flat ends are connected by means of a threaded bolt. By tightening threaded bolt nuts, the flat ends are moved toward each other. Thereby the cross section of the hollow cylinder shaped rail body is narrowed, which in turn clamps tight the connecting member. A further guide rail is slipped onto the free half of the connecting member and clamped tight by means of holding members and locking bolts on the connecting member.

SUMMARY OF THE INVENTION

The present invention concerns a guide rail assembly utilized to guide an elevator car or a counterweight in an elevator shaft. A pair of guide rails each has a hollow cylinder-shaped rail body. A tube shaped connecting member is inserted into adjacent ends of the guide rails has at least one opening formed therein. A base plate has at least one wedge body extending therefrom and is placed under the free ends of the guide rails such that the wedge body extends into the opening expanding the connecting member into locking engagement with the guide rails.

The present invention solves the problem of avoiding the disadvantages of the known construction and by creating a connecting element by means of which Ω-shaped guide rails can be mounted like conventional guide rails.

The advantages realized by the invention can be seen essentially in the fact, that the rail body forming the contact surface for the guide shoes or guiding pulleys, especially in the region of the rail joint is not deformed. The force for the production of the guide rail connection starts from the connecting member and acts uniformly onto the rail body. Thereby also local deformations on the rail body are avoided. The guide shoes and the guiding pulleys glide and roll respectively without jerk and without noise across the connecting points of the guide rails.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
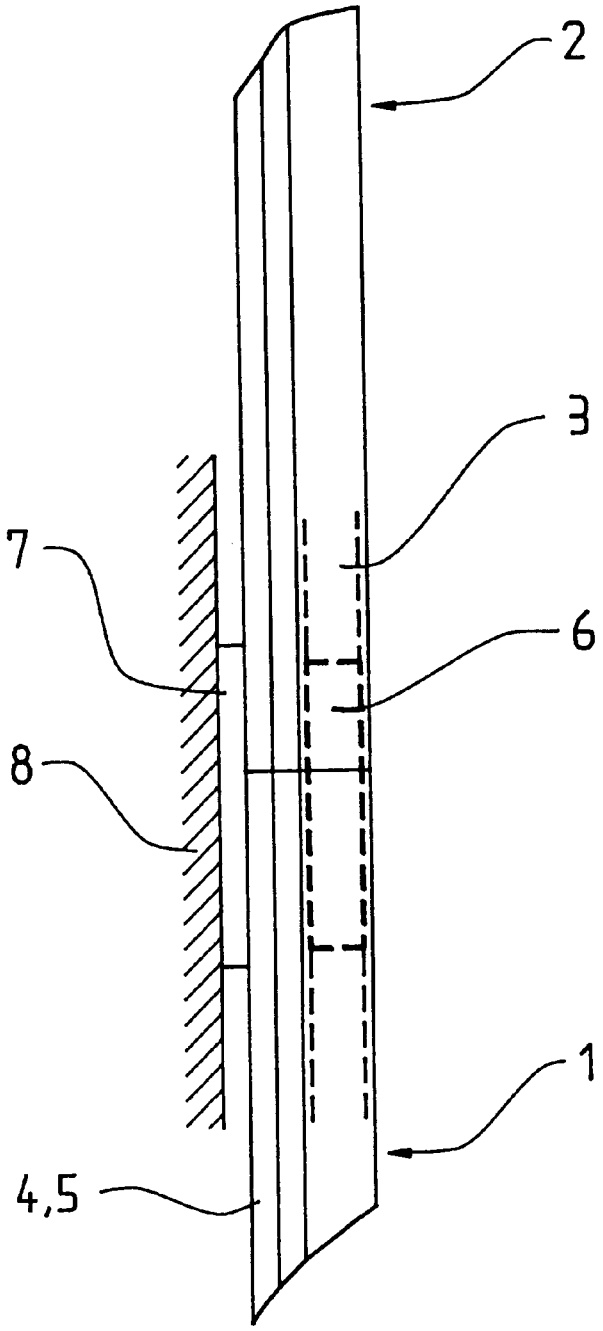
FIG. 1 is an elevation view of a connecting element in accordance with the present invention at a connecting point of two Ω-shaped guide rails.

In the FIGS. 1 through 5*c* there is shown a first Ω-shaped guide rail 1 for the guidance of an elevator car or of a counterweight, which rail is connected with a second Ω-shaped guide rail 2. The guide rails 1 and 2 have a hollow cylinder-shaped rail body 3, along which not illustrated guide shoes and guiding pulleys are gliding and rolling respectively and guide a not illustrated elevator car or a not illustrated counterweight. The guide rails 1 and 2 each have a pair of opposed, outwardly and longitudinally extending flat ends 4 and 5. The flat ends 4 and 5 and the rail body 3 are a single piece formed in the shape of the symbol Ω. Other shapes, for example egg shapes or teardrop shapes, are also possible. Slid into the rail body 3 is a tube shaped connecting member 6, which member is inserted approximately one half of its length into the rail body of each of the guide rails 1 and 2. A base plate 7 is placed under the flat ends 4 and 5 and is in operative connection with the connecting member 6 for establishment of the guide rail connection. The base plate 7 may or may not be attached to a beam 8, for example to a wall or to a steel girder. During the assembly, the first guide rail 1 is installed in an elevator shaft, subsequently the connection member 6 is slid into the end of the first guide rail, the second guide rail 2 is installed on the connection member to abut the end of the first guide rail, and finally the base plate 7 is placed under the guide rails and the guide rail connection is established as illustrated and explained below.

Figure 2A:
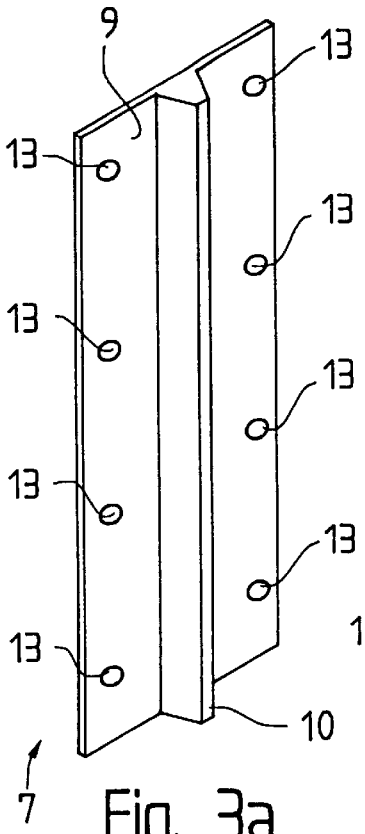
FIGS. 2*a* through 2*c* show a base plate with a wedge body, a connecting member and an assembly of those two parts for the connecting element shown in the FIG. 1.
Figure 2B:
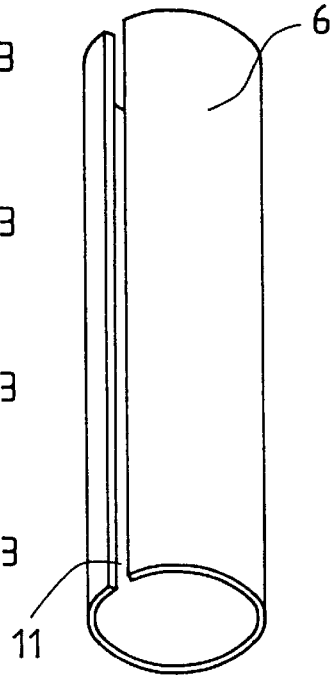
Figure 2C:
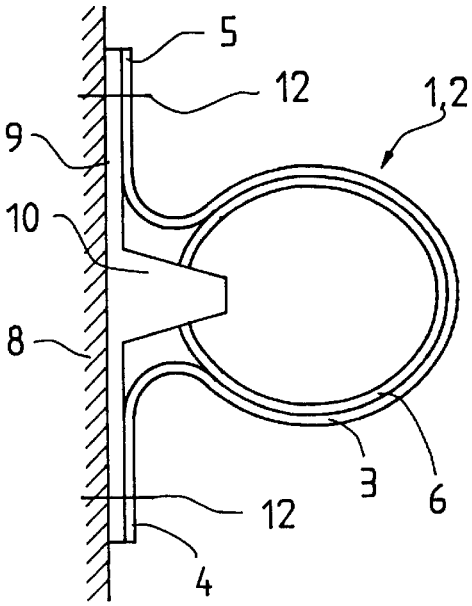

The FIGS. 2*a* through 2*c* show the base plate 7 consisting of a wedge shaped wedge body 10 connected to an extending outwardly from a generally planar base body 9. The wedge body 10 is dimensioned in such a way that it fits into an opening, for instance into an axially running slot 11, formed in the connecting member 6. The slot 11 is oriented adjacent the flat ends 4 and 5 when the connecting member 6 is inserted into the first guide rail 1. For establishment of the guide rail connection, the base plate 7 is attached to the free ends 4 and 5 by fastening elements 12, for example screws or bolts penetrating holes 13 formed in the base body 9. In this way, the wedge body 10 is pressed into the slot 11 of the connecting member 6 and the connecting member is uniformly enlarged or expanded. By the enlargement of the connecting member 6, a solid releasable locking connection between the connecting member and the rail body 3 is created. The guide rail connection is completely established as soon as all of the fastening elements 12 have been tightened.

Figure 3A:
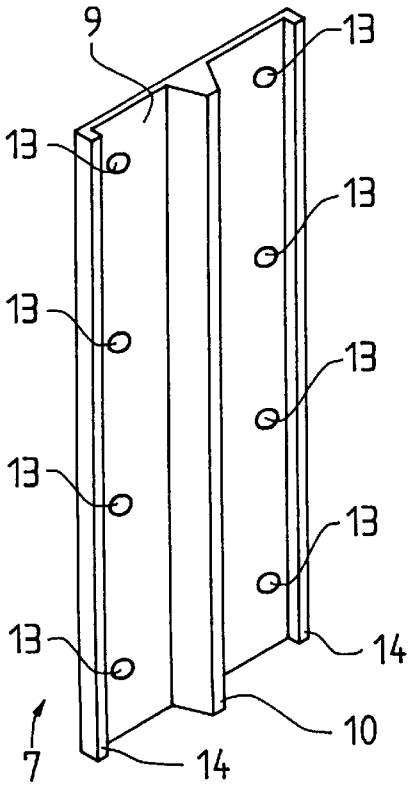
FIGS. 3*a* through 3*c* are similar to the FIGS. 2*a* through 2*c* respectively and show a first alternate embodiment of the connecting element with lateral bosses on the base plate.
Figure 3B:
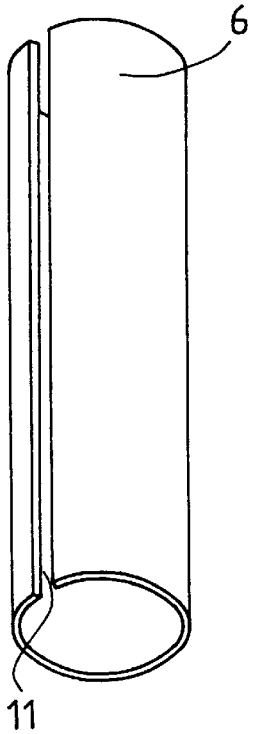
Figure 3C:
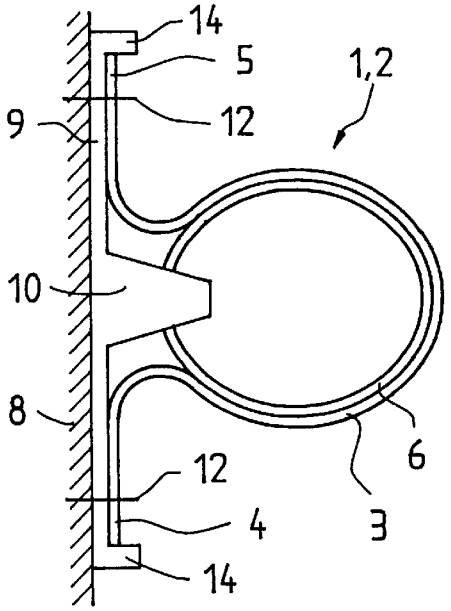

The FIGS. 3*a* through 3*c* show an alternate embodiment connecting element having an alternate base plate 7*a* with upwardly extending stops 14 arranged laterally on edges of base body 9, which stops avoid a yielding of the free ends 4 and 5 due to the enlargement of the connecting member 6 upon tightening of the bolts 13.

Figure 4A:
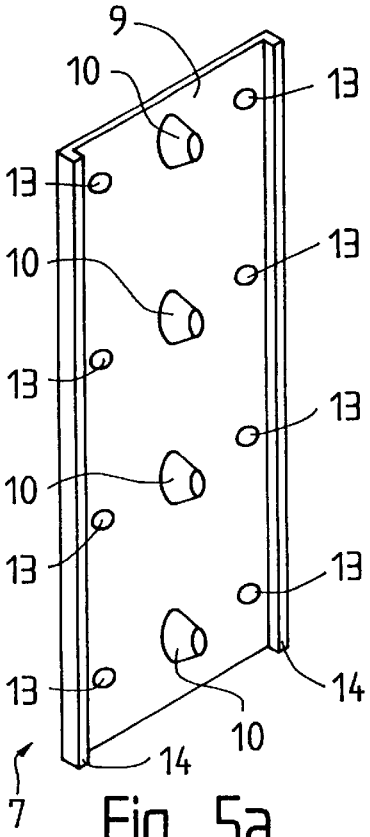
FIGS. 4*a* through 4*c* are similar to the FIGS. 2*a* through 2*c* respectively and show a second alternate embodiment of the connecting element with multiple wedge bodies on the base plate.
Figure 4B:
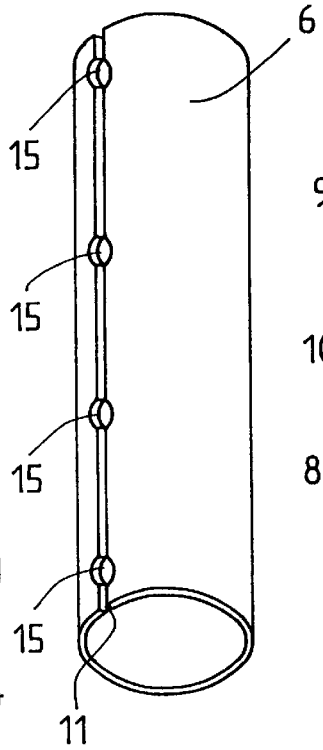
Figure 4C:
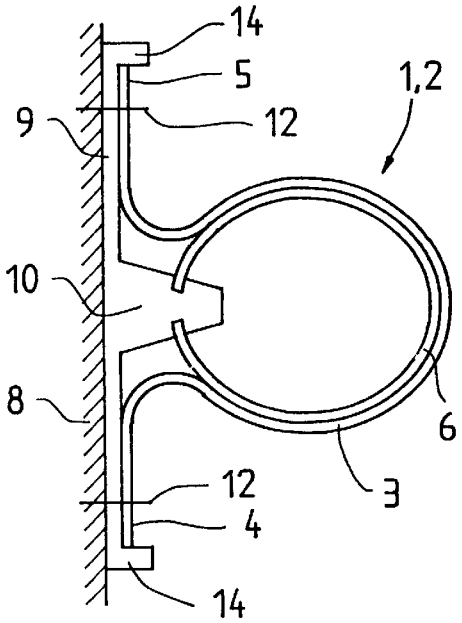

The FIGS. 4*a* through 4*c* show a second alternate embodiment connecting member having second alternate base plate 7*b* with a plurality of truncated cone shaped wedge bodies 10*a* extending therefrom. The wedge bodies 10*a* fit into openings such as bore holes 15 arranged along the slot 11. It is advantageous in this variant, that the truncated cone shaped wedge bodies 10*a* retain and position the connecting member 6. The wedge bodies 10*a* shown in the FIG. 4*a* are arranged solidly on the base body 9, and the establishment of the guide rail connection takes place as shown and described above. The wedge bodies 10*a* can also be arranged adjustably by means of bolts on the base body 9. The establishment of the guide rail locking connection then takes place as illustrated and described below.

Figure 5A:
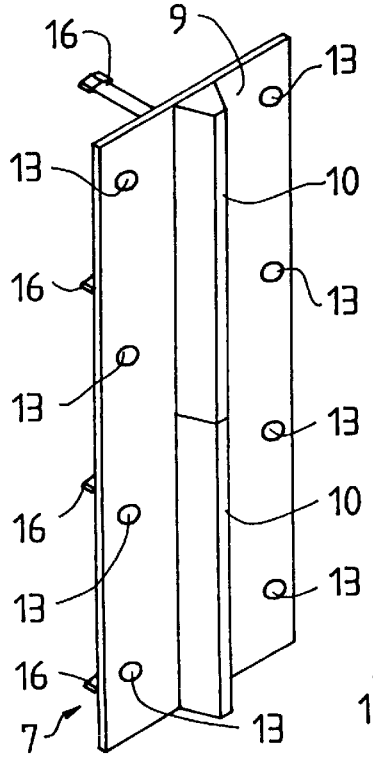
FIGS. 5*a* through 5*c* are similar to the FIGS. 2*a* through 2*c* respectively and show a third alternate embodiment of the connecting element with adjustable wedge bodies on the base plate.
Figure 5B:
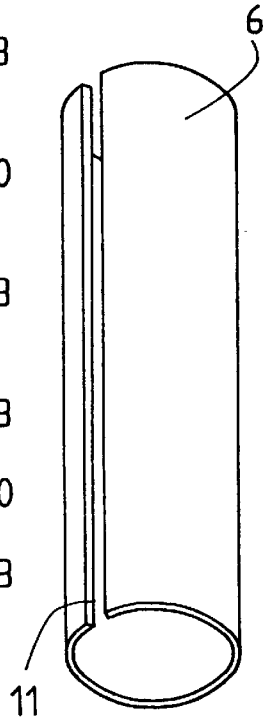
Figure 5C:
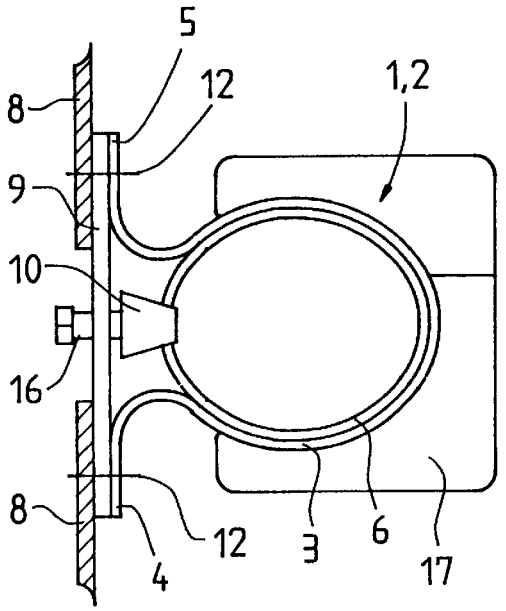

The FIGS. 5*a* through 5*c* show a third alternate connecting member having a third alternate base plate 7*c* with elongated wedge bodies 10*b* adjustable by means of bolts 16 threaded through the base plate. Shown are two of the wedge bodies 10*b* each engaging two of the bolts 16. It is also possible to have one or more of the wedge bodies 10*b* with a corresponding number of the bolts 16. For establishment of the guide rail connection, the base plate 7*c* is placed under the free ends 4 and 5, which are then attached by means of the fastening elements 12. Thereafter, the wedge bodies 10*b* enlarging or spreading the connecting member 6, are driven into the slot 11 by rotating the bolts 16, until a solid, releasable locking connection between the connecting member and the rail body 3 is produced. Prior to the enlargement of the connecting member 6, a tool 17 extending over the guide rail joint region is placed onto the rail body 3, which tool maintains the rail body in correct shape during the establishment of the guide rail connection.

In summary the guide rail assembly according to the present invention includes: at least a pair of the guide rails 1 and 2, each having the hollow cylinder-shaped rail body 3 and the free ends 4 and 5; the tube shaped connecting member 6 inserted into adjacent ends of the guide rails, the connecting member having at least the one opening 11 and 15 formed therein; and the base plate 7, 7*a*, 7*b* and 7*c* having at least the one wedge body 10, 10*a* and 10*b* extending therefrom, the base plate being placed under the free ends of the guide rails and the wedge body extending into the opening expanding the connecting member into locking engagement with the guide rails.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A connecting element for guide rails (1, 2) utilized to guide an elevator car or a counterweight in an elevator shaft, the guide rails having a hollow cylinder-shaped rail body (3) and free ends (4, 5), comprising:

a tube shaped connecting member (6) for insertion into adjacent ends the two guide rails (1, 2), said connecting member having at least one opening (11, 15) formed therein; and a base plate (7, 7*a*, 7*b*, 7*c*) having at least one wedge body (10, 10*a*, 10*b*) extending therefrom whereby when said connecting member (6) is inserted into the adjacent ends of the guide rails (1, 2) and said base plate is placed under the free ends (4, 5) of the guide rails, said wedge body extends into said opening (11, 15) in said connecting member for expanding said connecting member into locking engagement with the guide rails.

2. The connecting element according to claim 1 wherein said opening in said connecting member (6) is formed as an axially extending slot (11) and said wedge body (10, 10*b*) is elongated for insertion into said slot during assembly of the guide rails (1, 2).

3. The connecting element according to claim 1 wherein said opening includes at least one bore hole (15) arranged along an axially extending slot (11) formed in said connecting member (6) and said wedge body includes at least one truncated cone shaped wedge body (10*a*) for insertion into said bore hole during assembly of the guide rails (1, 2).

4. The connecting element according to claim 1 wherein said base plate (7*c*) has a base body (9), and said wedge body includes at least one adjustable wedge body (10*b*) movable relative to said base body for insertion into said opening (11) during assembly of the guide rails (1, 2).

5. The connecting element according to claim 4 including at least one bolt (16) threadably engaged with said base body (9) and connected to said wedge body (10*b*) for moving said wedge body relative to said base body.

6. The connecting element according to claim 1 wherein said base plate (7*a*, 7*b*) has a pair of stops (14) formed along longitudinal edges thereof for guiding the free ends (4, 5) of the guide rails (1, 2).

7. A guide rail assembly utilized to guide an elevator car or a counterweight in an elevator shaft comprising:

at least a pair of guide rails (1, 2) each having a hollow cylinder-shaped rail body (3) and free ends (4, 5);

a tube shaped connecting member (6) inserted into adjacent ends of said guide rails (1, 2), said connecting member having at least one opening (11, 15) formed therein; and a base plate (7, 7*a*, 7*b*, 7*c*) having at least one wedge body (10, 10*a*, 10*b*) extending therefrom, said base plate being placed under said free ends (4, 5) of said guide rails (1, 2) and said wedge body extending into said opening (11, 15) expanding said connecting member (6) into locking engagement with said guide rails.

* * * * *